US006113488A

United States Patent [19]

Tiede

[11] Patent Number: 6,113,488

[45] **Date of Patent: *Sep. 5, 2000**

[54] METHOD OF RETROFITTING VENTILATION SYSTEMS WITH SECURITY GRILLES

[75] Inventor: Irvin Richard Tiede, Sherwood Park, Canada

[73] Assignee: Safety Concepts Inc., Sherwood Park, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/086,188

[22] Filed: May 28, 1998

[30] Foreign Application Priority Data

Apr. 17, 1998 [CA] Canada ..... 2235084

[51] Int. Cl.[7] ..... F24F 13/20

[52] U.S. Cl. ..... 454/276; 454/277

[58] Field of Search ..... 109/1 R, 1 V; 454/271, 272, 273, 274, 275, 276, 277, 278, 279, 280, 281, 282, 283, 330, 331, 332

[56] References Cited

U.S. PATENT DOCUMENTS

| | | | |
|---|---|---|---|
| 637,519 | 11/1899 | Mertins | 454/330 X |
| 1,442,588 | 1/1923 | Tompkins | 454/277 X |
| 1,650,569 | 11/1927 | Nickle . | |
| 2,790,376 | 4/1957 | Kennedy et al. | 454/331 |
| 2,848,936 | 8/1958 | Vallero . | |
| 3,124,903 | 3/1964 | Truhan . | |
| 3,502,016 | 3/1970 | Steele | 454/277 X |
| 4,512,241 | 4/1985 | Morris et al. . | |
| 4,911,066 | 3/1990 | Carew | 454/277 X |

FOREIGN PATENT DOCUMENTS

| | | | |
|---|---|---|---|
| 61-165537 | 7/1986 | Japan | 454/276 |

*Primary Examiner*—Harold Joyce
*Attorney, Agent, or Firm*—Davis and Bujold

[57] ABSTRACT

A method of retrofitting ventilation systems with security grilles. A first step involves providing a security grille that is larger in size than an existing air duct to be covered by the security grille. The security grille has a flow area sufficient to permit a desired number of air exchanges per hour within a holding cell. A second step involves forming an enlarged plenum chamber where the existing air duct passes through a wall into the holding cell. The plenum chamber has a flow area compatible with the security grille. A third step involves attaching the security grille over the plenum chamber, such that the security grille is fed by a flow of air through the plenum chamber.

3 Claims, 3 Drawing Sheets

FIG. 1
(Prior Art)
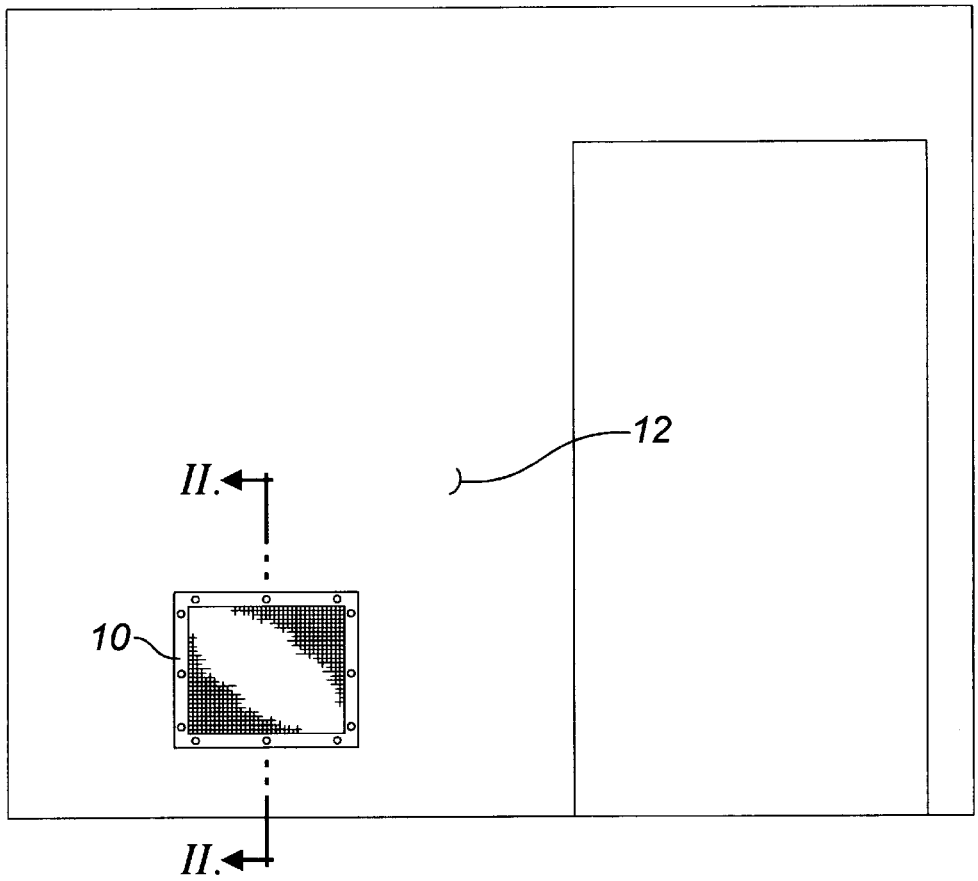
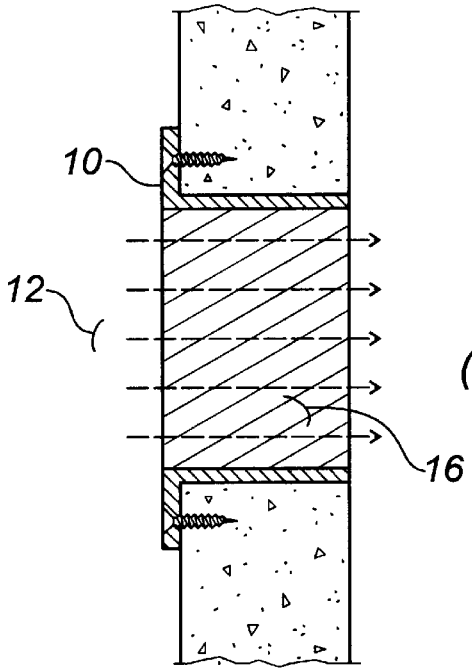
FIG. 2
(Prior Art)

FIG. 5
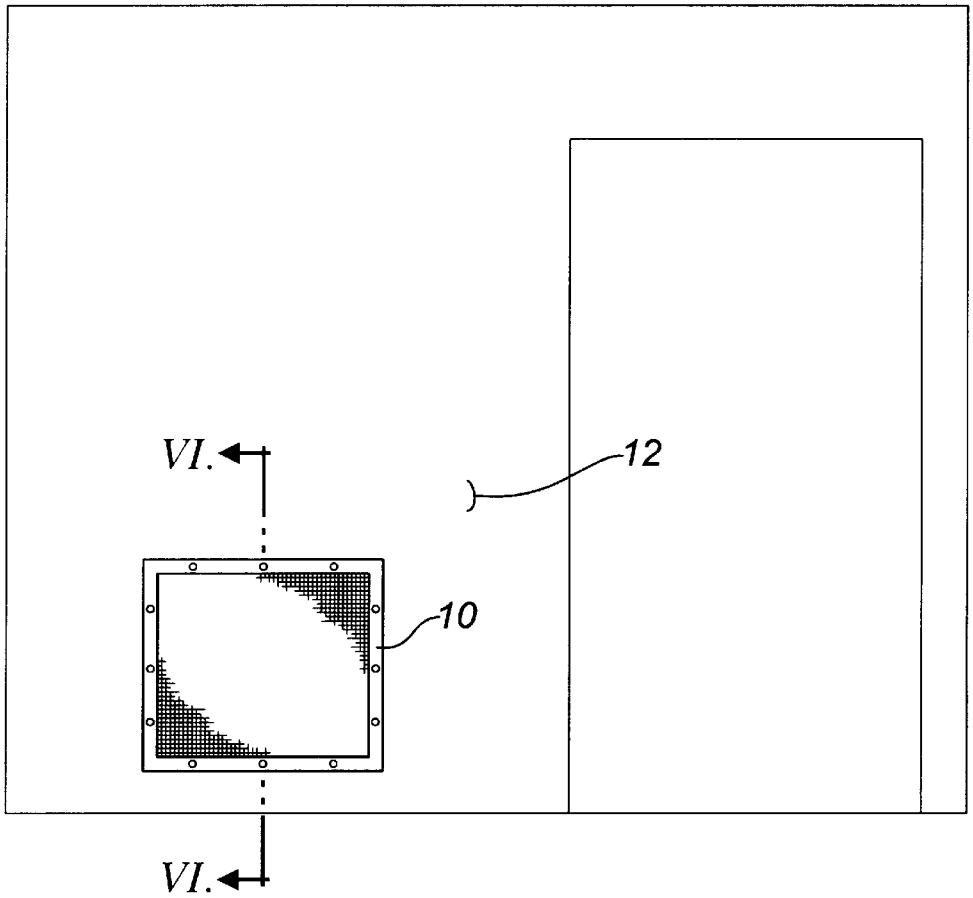
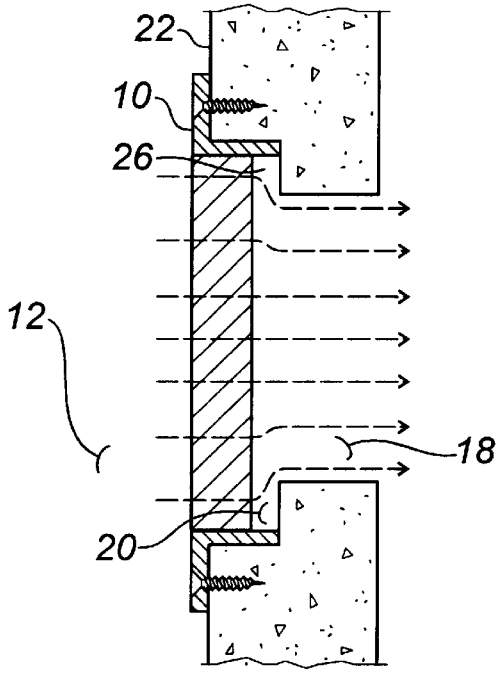
FIG. 6

METHOD OF RETROFITTING VENTILATION SYSTEMS WITH SECURITY GRILLES

FIELD OF THE INVENTION

The present invention relates to a method of retrofitting ventilation systems with security grilles.

BACKGROUND OF THE INVENTION

Security grilles are used to meet special requirements of ventilation systems of penal institutions and prisoner detention cells. The grilles must not be readily removable in order to address concerns regarding escape, the concealment of weapons, drugs or other prohibited contraband. The grilles must be difficult for a person wishing to commit suicide by hanging to attach a line.

A number of factors have lead to a major renovation program relating to the ventilation systems in our penal institutions. One factor is a desire on the part of the penal institutions to prevent the concealment of weapons and drugs. Another factor is a desire on the part of the institutions to eliminate suicide death by hanging. Yet another factor are studies regarding the need for an increased number of changes in the air of the cell per hour in order to maintain the mental and physical health of inmates. Some penal institutions which were built with ventilation systems capable of handling three to six air changes per hour, are faced with the task of upgrading to as many as 20 air changes per hour to meet the requirements of State laws regarding prisoners rights.

In order to change the air in a prison cell twenty times every hour, a larger grille is required than would be required to change the air in a prison cell only six times per hour. The greater security provided by a grille, the less area is available to provide for air flow. A lower security grille might have 50% or more of its surface area available for air flow, whereas a higher security grille might only have 25% to 35% of its surface area available for air flow. In order to accommodate greater security, more frequent air changes, or both; grilles with substantially larger surface area are being installed. This requires that ducts be enlarged through concrete walls at considerable cost. Sometimes the enlarging of the ducts is practically impossible due to a heavy metal flange bordering the air duct.

SUMMARY OF THE INVENTION

What is required is a more cost effective method of retrofitting ventilation systems with security grilles to either increase security or the frequency of the air changes.

According to the present invention there is provided a method of retrofitting ventilation systems with security grilles. A first step involves providing a security grille that is larger in size than an existing air duct to be covered by the security grille. The security grille has a flow area sufficient to permit a desired number of air exchanges per hour within a holding cell. A second step involves forming an enlarged plenum chamber where the existing air duct passes through a wall into the holding cell. The plenum chamber has a flow area compatible with the security grille. A third step involves attaching the security grille over the plenum chamber, such that the security grille is fed by a flow of air through the plenum chamber.

The use of a plenum chamber, as described above, provides a flow of air that is sufficient to meet flow requirements of a security grille that is much larger in area than the existing air duct. There are two ways that this can be done, as will hereinafter be further described. The enlarged plenum chamber can be formed by cutting into the wall a peripheral recessed border around the air duct where the air duct passes through the wall into the holding cell. Where cutting into the wall is not practical, the enlarged plenum chamber can be formed by attaching an intermediate enclosure to a wall adjacent to the air duct.

BRIEF DESCRIPTION OF THE DRAWINGS

These and other features of the invention will become more apparent from the following description in which reference is made to the appended drawings, wherein:

FIG. 1 labelled as PRIOR ART is a front elevation view of a security grille installed in a holding cell.

FIG. 2 is a section view taken along section lines II.—II. of FIG. 1.

FIG. 5 is a front elevation view of a security grille installed in a holding cell in accordance with another aspect of the preferred method.

FIG. 6 is a section view taken along section lines VI.—VI. of FIG. 5.

DETAILED DESCRIPTION OF THE PREFERRED EMBODIMENT

Figure 3:
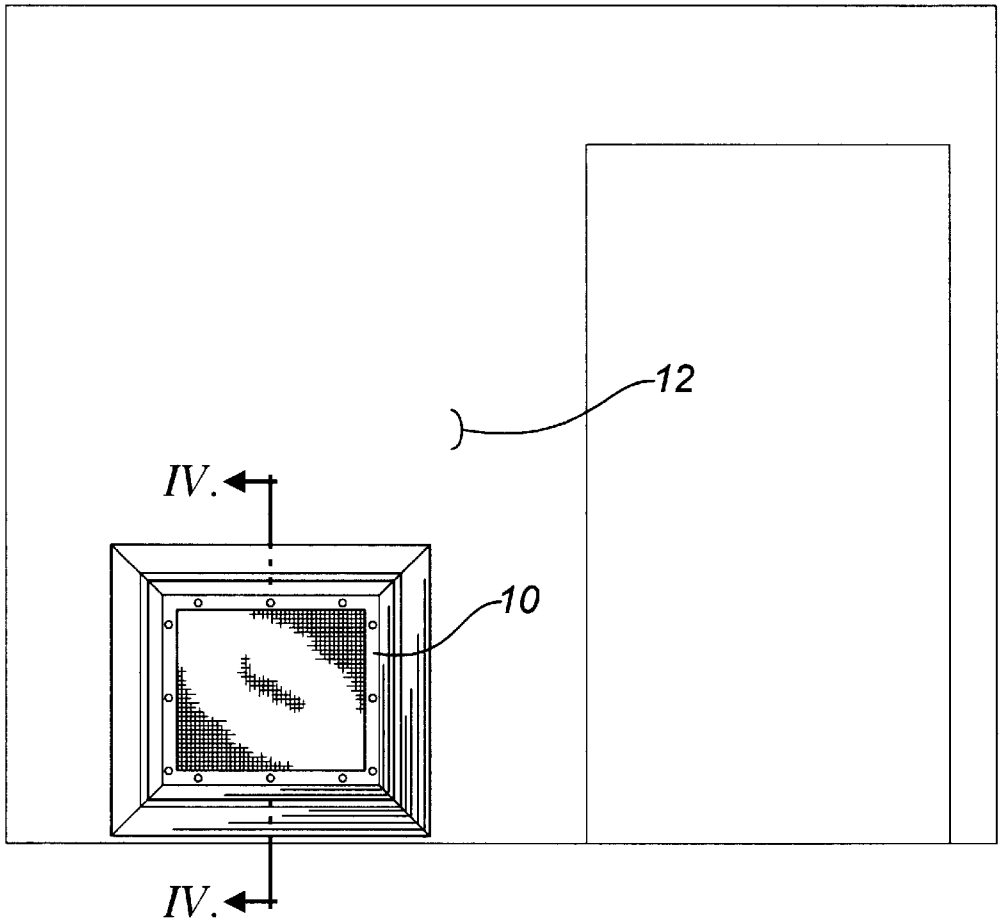
FIG. 3 is a front elevation view of a security grille installed in a holding cell in accordance with one aspect of the preferred method.

Referring to FIG. 1, there is illustrated the PRIOR ART approach to retrofitting ventilation systems with security grilles. In accordance with the prior art methodology, a security grille 10 is selected that has a flow area sufficient to permit a desired number of air exchanges per hour within a holding cell 12. Referring to FIG. 2, in order to accommodate security grille 10, which is invariably larger in area than the existing air duct; the existing air duct must be enlarged to provide a compatible air flow. This enlarged air duct is identified by reference numeral 16.

Figure 4:
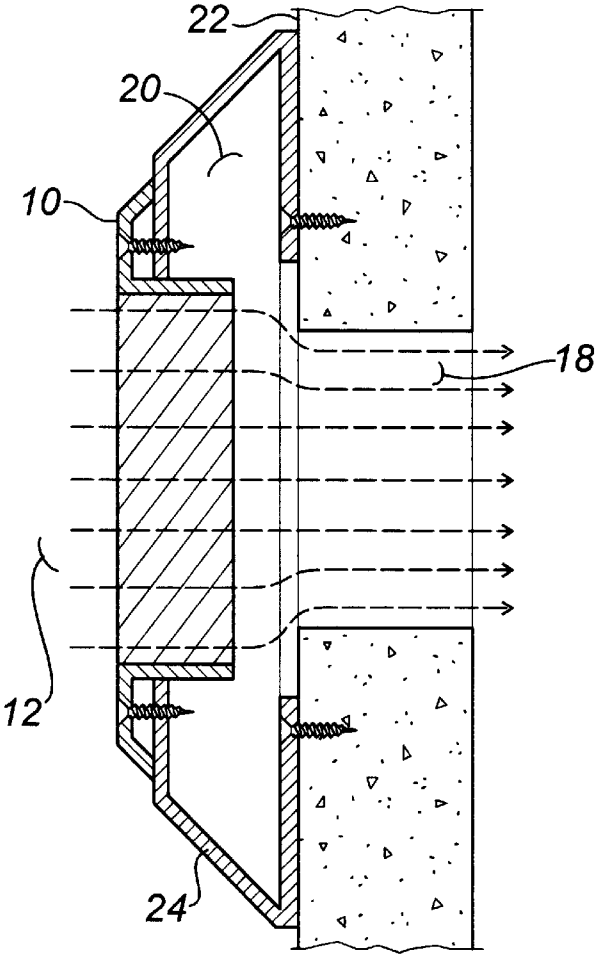
FIG. 4 is a section view taken along section lines IV.—IV. of FIG. 3.

The preferred method will now be described with reference to FIGS. 3 through 6. Referring to FIGS. 4 and 6, a first step involves providing security grille 10 that is larger in size than an existing air duct 18 to be covered by the security grille. As before, security grille 10 has a flow area sufficient to permit a desired number of air exchanges per hour within holding cell 12. A second step involves forming an enlarged plenum chamber, generally identified by reference numeral 20, where existing air duct 18 passes through a wall 22 into holding cell 12. Plenum chamber 20 has a flow area compatible with security grille 10. A third step involves attaching security grille 10 over plenum chamber 20, such that security grille 10 is fed by a flow of air through plenum chamber 20, without enlarging existing air duct 18 as taught in the prior art. There are two ways that this can be done. Referring to FIG. 4, plenum chamber 20 can be formed by attaching an intermediate enclosure 24 to wall 22 adjacent to existing air duct 18. Referring to FIG. 6, plenum chamber 20 can be formed by cutting into wall 22 a peripheral recessed border 26 around existing air duct 18 where existing air duct 18 passes through wall 22 into holding cell 12.

It will be apparent to one skilled in the art that the use of plenum chamber 20, as described above, provides a flow of air that is sufficient to meet flow requirements of security grille 10, even through security grille 10 is much larger in flow area than existing air duct 18. It will also be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of retrofitting a ventilation system for a holding cell with a replacement security grille, the method comprising the steps of:

removing an existing security grille from an existing air duct in a wall of a holding cell;

providing a replacement security grille having a surface area larger than a transverse opening of the existing air duct to be covered by the replacement security grille, and the replacement security grille having an air passage surface area which at least as large as the opening of the existing air duct in the wall of the holding cell and sufficient to permit a desired number of air exchanges per hour within a holding cell;

forming an enlarged plenum chamber where the existing air duct passes through the wall into the holding cell by attaching an intermediate enclosure to the wall adjacent to the existing air duct, and the enlarged plenum chamber having an air passage area which at least as large as the opening of the existing air duct in the wall of the holding cell and compatible with the security grille; and attaching the security grille over the enlarged plenum chamber such that the replacement security grille is fed by a flow of air through the enlarged plenum chamber.

2. A method of retrofitting a ventilation system for a holding cell with at least one replacement security grille, the method comprising the steps of:

removing an existing security grille, at least partially extending into an opening of an existing air duct and thereby partially restricting air flow therethrough, from the opening of the existing air duct in a wall of a holding cell to completely expose the opening of the existing air duct;

providing a replacement security grille having a transverse cross sectional surface area larger than a transverse cross sectional surface area of the opening of the existing air duct to be covered by the replacement security grille, and the replacement security grille also having a transverse cross sectional air flow passage area which is also larger than a transverse cross sectional flow area of the opening of the existing air duct to be covered and is sufficient to permit a number of air exchanges per hour within the holding cell;

forming an enlarged plenum chamber about a perimeter where the existing air duct passes through the wall into the holding cell by attaching an intermediate enclosure to the wall adjacent to the existing air duct, the enlarged plenum chamber having a transverse cross sectional air passage area compatible with the security grille and the transverse cross sectional air passage area of the enlarged plenum chamber being larger than the opening of the existing air duct to be covered; and attaching the replacement security grille over the enlarged plenum chamber such that the replacement security grille is directly fed by a flow of air through the enlarged plenum chamber without any other component being located in an air flow path between the replacement security grille and the existing air duct to facilitate the desired number of air exchanges per hour within the holding cell.

3. A method of retrofitting a ventilation system for a plurality of holding cells with a plurality of replacement security grilles, the method comprising the steps of:

removing a plurality of existing security grilles, at least partially extending into openings of existing air ducts and thereby partially restricting air flow therethrough and only allowing about six air changes per hour, from the openings of the existing air ducts in walls of holding cells to completely expose the openings of the existing air ducts;

providing a plurality of replacement security grilles each having a transverse cross sectional surface area larger than a transverse cross sectional surface area of the opening of the existing air duct to be covered by one of the a plurality of replacement security grilles, and each one of the replacement security grilles having a transverse cross sectional air passage area which is larger than a transverse cross sectional flow area of the opening of the existing air ducts to be covered and which is sufficient to permit about twenty air exchanges per hour within the holding cells;

forming an enlarged plenum chamber about a perimeter of each one of the existing air ducts to be covered by attaching an intermediate enclosure to the wall adjacent to the existing air duct to be covered, and each enlarged plenum chamber having a transverse cross sectional air passage area compatible with the air passage area of the replacement security grille and the transverse cross sectional air passage area of each enlarged plenum chamber being larger than the opening of the existing air duct to be covered; and attaching one of the replacement security grilles over each one of the enlarged plenum chambers such that the replacement security grille is fed by a flow of air through the associated enlarged plenum chamber and communicates directly with the associated air duct in the wall of the holding cell without any component being located in an air flow path between the replacement security grille and the existing air duct to facilitate unrestricted air flow therebetween and about twenty air exchanges per hour within each of the holding cells.

* * * * *